US008198831B2

(12) United States Patent
Matsuoka et al.

(10) Patent No.: US 8,198,831 B2
(45) Date of Patent: Jun. 12, 2012

(54) LED LAMP-LIGHTING CIRCUIT AND LED LAMP AS WELL AS AN LED LAMP-LIGHTING CONVERSION SOCKET

(75) Inventors: Tomomi Matsuoka, Kanzaki-gun (JP); Shunsuke Nakagawa, Kanzaki-gun (JP); Kazuya Kurokawa, Kanzaki-gun (JP); Toshio Takahashi, Uji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 391 days.

(21) Appl. No.: 12/630,151

(22) Filed: Dec. 3, 2009

(65) Prior Publication Data

US 2010/0134049 A1 Jun. 3, 2010

(30) Foreign Application Priority Data

Dec. 3, 2008 (JP) ..... 2008-308491

(51) Int. Cl.
*H05B 37/02* (2006.01)

(52) U.S. Cl. ..... 315/307; 315/291; 362/800

(58) Field of Classification Search ..... 315/307, 315/291; 362/800

See application file for complete search history.

(56) References Cited

U.S. PATENT DOCUMENTS 7,812,550 B2 * 10/2010 Harmgardt et al. ..... 315/291
8,004,210 B2 * 8/2011 Harmgardt et al. ..... 315/291
2010/0259185 A1 * 10/2010 Sadwick et al. ..... 315/291
2011/0148325 A1 * 6/2011 Trovo' ..... 315/307
2011/0248640 A1 * 10/2011 Welten ..... 315/210

FOREIGN PATENT DOCUMENTS

JP 2006-344919 A 12/2006

* cited by examiner

*Primary Examiner* — Jacob Y Choi
*Assistant Examiner* — Anthony Arpin
(74) *Attorney, Agent, or Firm* — Roberts Mlotkowski Safran & Cole, P.C.; David S. Safran

(57) ABSTRACT

To stably illuminate an LED lamp even when an internally-excited electronic transformer is used in the power supply circuit, the full wave of the AC voltage supplied from the power supply circuit is rectified using a current rectifying circuit. When the power supply starts, current flows into a start-assist circuit for a specific period of time. Subsequently, when the fixed current load circuit begins operating, the current will flow into the fixed current load circuit. When the current flows into the LED driver, operation of the fixed current load circuit is stopped by a current-stopping circuit. Because the current flows into the lamp-lighting circuit across the entire voltage output even when an internally-excited electronic transformer is used in the power supply circuit, operation of the internally-excited electronic transformer will not stop and will not become unstable. When the LED is not connected, the fixed current load circuit is stopped.

5 Claims, 12 Drawing Sheets

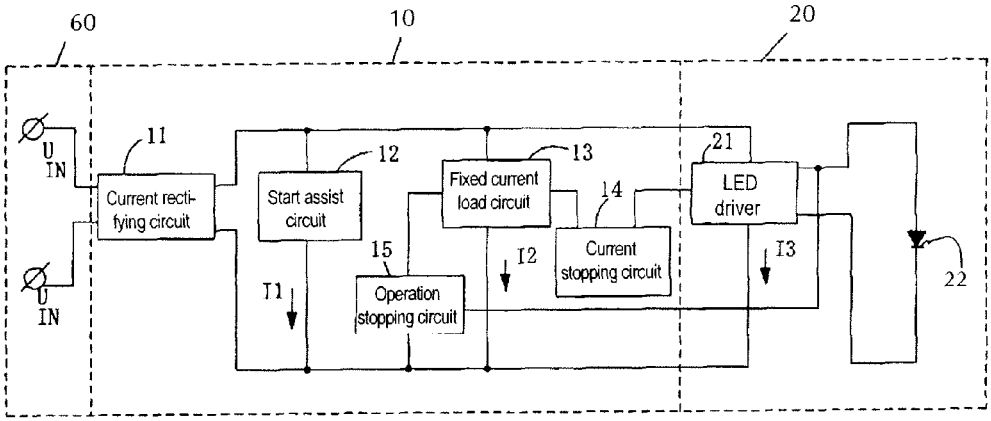
Fig. 2
Fig. 3
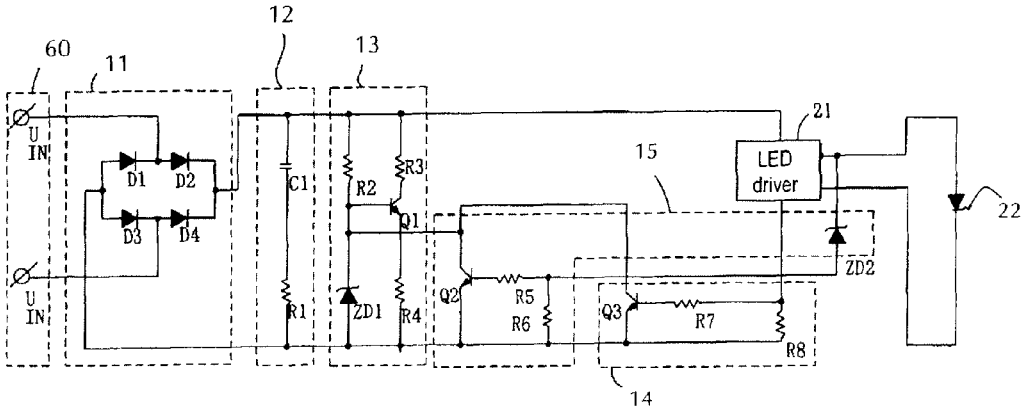

Input power
E
0
-E
Vdown
Vdown
Time

Rectified
voltage
E-Vdown
0
VCstart
VDstart
Time

I1
E-Vdown
Z
0
Time

I2
I2MAX
0
Time

I3
I3MAX
0
Time

I
I2MAX
I3MAX
0
Time

Fig. 10 (a)
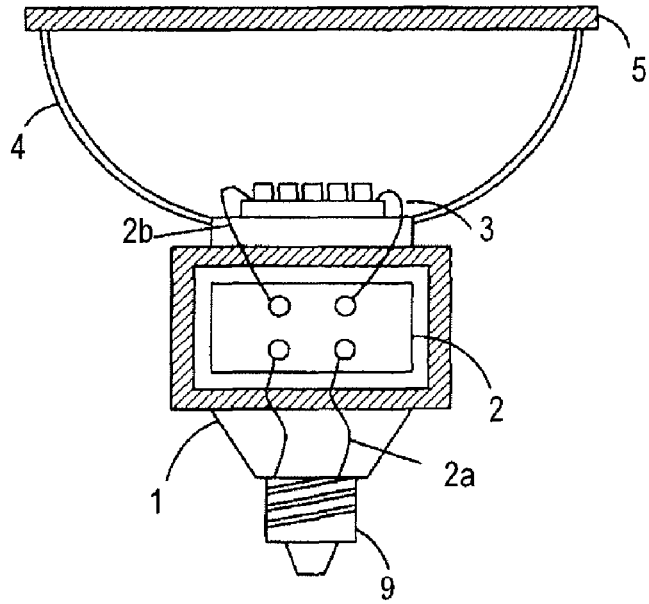
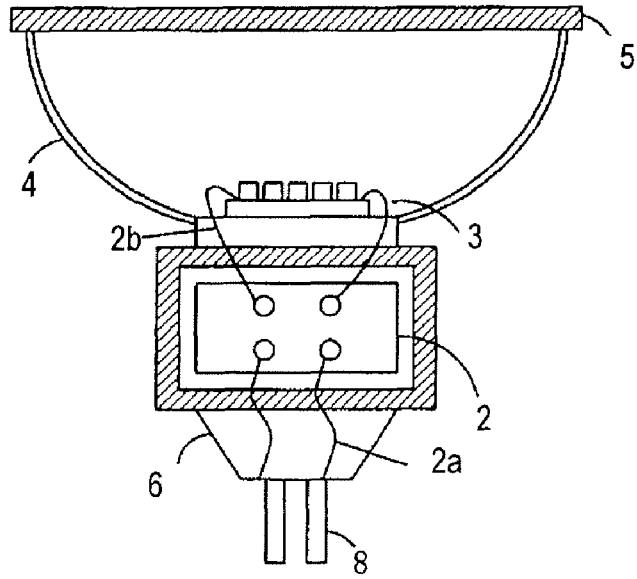
Fig. 10 (b)

Fig. 11 (a)
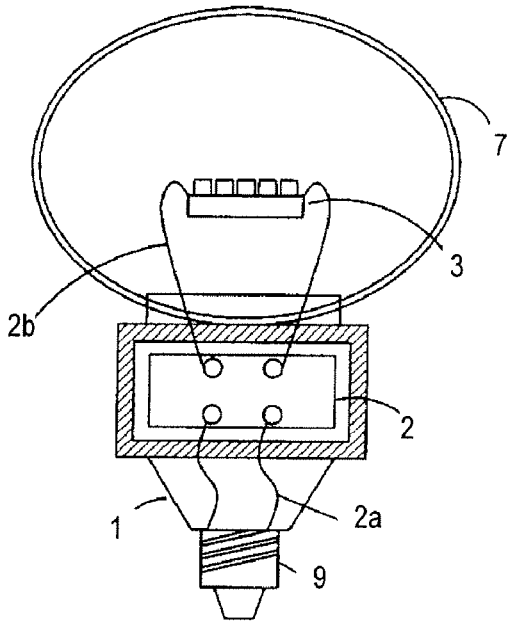
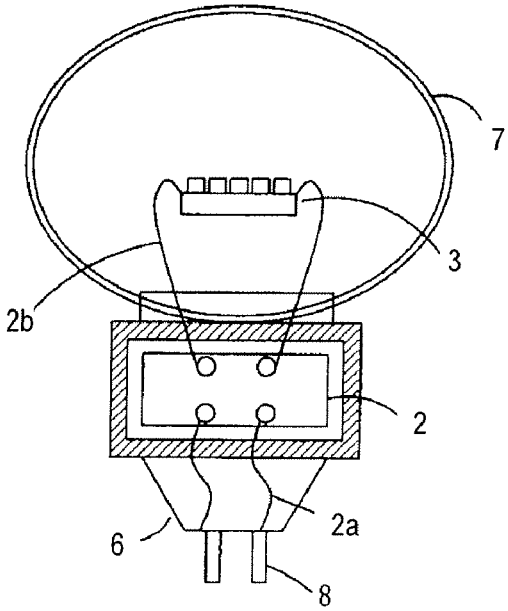
Fig. 11 (b)

Fig. 12 (a)
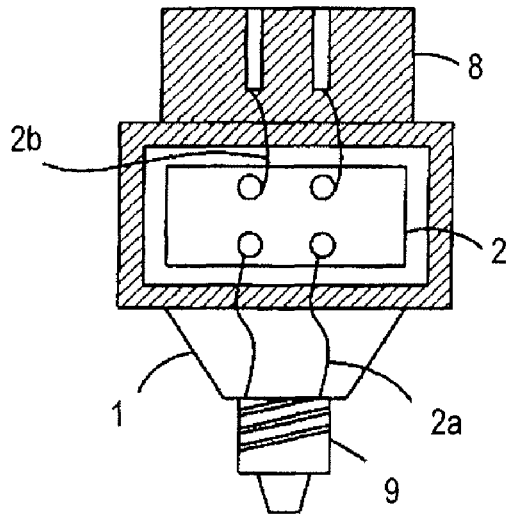
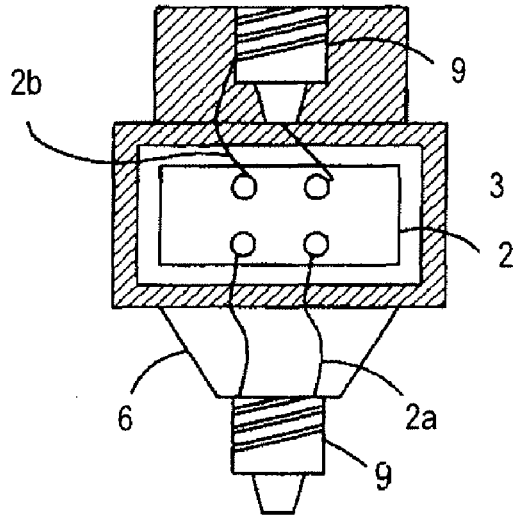
Fig. 12 (b)

Fig. 15 (a) (Prior Art)
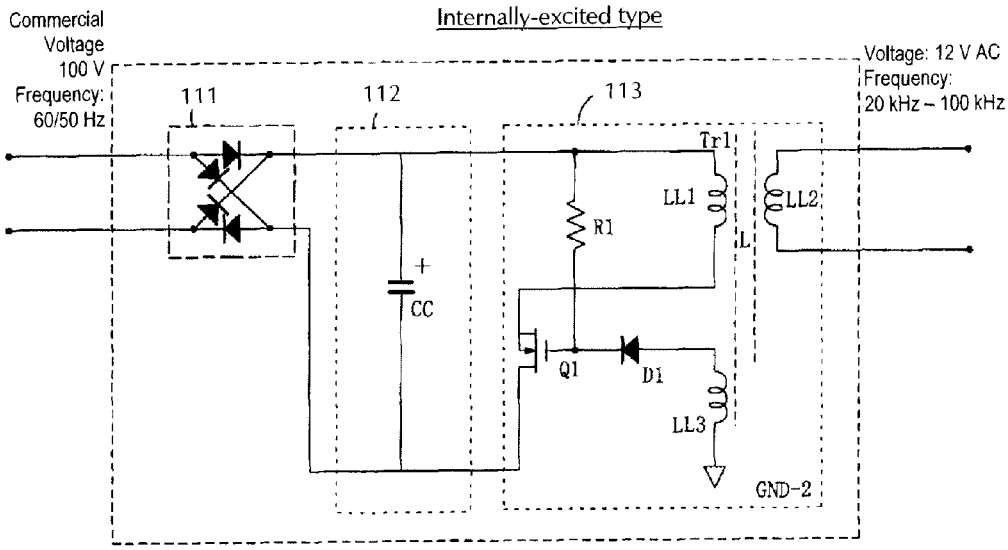
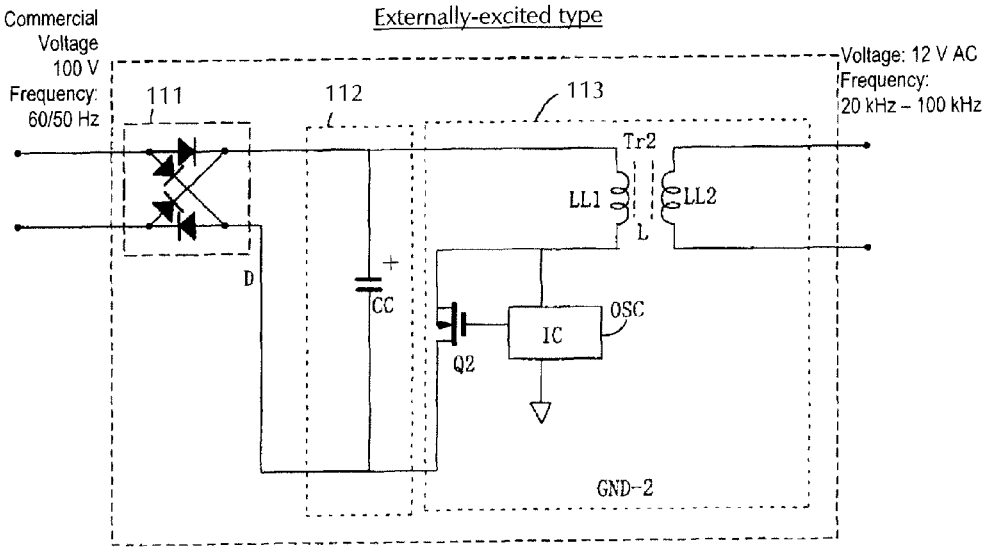
Fig. 15 (b) (Prior Art)

LED LAMP-LIGHTING CIRCUIT AND LED LAMP AS WELL AS AN LED LAMP-LIGHTING CONVERSION SOCKET

BACKGROUND OF THE INVENTION

1. Field of Invention

This invention pertains to light emitting diode (LED) lamp-lighting circuits that can light without fail and without flickering, In addition, the invention relates to LED lamps that have an LED as a light source, as well as to LED lamps and conversion socket devices used for lighting LED lamps that have said lamp-lighting circuits.

2. Description of Related Art

In recent years, for reasons of long-life, low power consumption, and the like, people have begun using lamps that use LEDs (light emitting diodes) (hereinafter "LED lamps") as the source of light for illumination.

For example, Japanese Unexamined Patent Application Publication 2006-344919 describes an LED lamp-lighting circuit that is used for illumination. FIG. 5 of this document shows an example of a lamp-lighting circuit that lights multiple LEDs.

FIG. 13 shows the lamp-lighting circuit of FIG. 5 of Japanese Unexamined Patent Application Publication 2006-344919. As shown in that figure, multiple LEDs are connected in a series/parallel configuration and the AC voltage that is stepped down by the voltage transformer T2 is rectified in the current rectifying circuit DB, smoothed in the capacitor C3 and then applied to the LEDs, which are connected in the series/parallel configuration described above via the current-limiting resistors R3, lighting them.

The LEDs are driven using direct current (DC) and when lighting LEDs using an AC power supply, the AC voltage must be rectified and converted into DC, as stated in the Japanese Unexamined Patent Application Publication 2006-344919 described above.

FIG. 14 shows an example of a lamp-lighting circuit that uses an LED driver. As shown in FIG. 14, the lamp-lighting circuit is made up of a current rectifying circuit 101, which has the current-rectifying diodes D1, D2, D3 and D4, and it rectifies AC, converting it into DC. It also has an LED drive circuit that has a smoothing circuit 102 that includes the capacitor C1 and the LED driver 103, which is equipped, among other things, with a DC-DC converter that drives the LED.

It is also noted that the LED driver 103 is equipped with a current-fixing function that keeps the current supply to the LED uniform. For example, if 12 V AC voltage was being supplied to the LED drive circuit described above, the LED would light up.

Generally, for example, the power supply voltage to the LED drive circuits described above would step down 100 V of commercial use AC voltage to a supply of 12 V.

In order to step down 100 V of commercial use AC voltage to 12 V, for example, requires the use of a transformer, but in recent years, in order to make devices more compact, AC-AC converters, so-called electronic transformers, have been gaining in use in place of the more conventional coil-wrapped, iron-core transformers (copper-iron transformers).

Electronic transformers either do not use the copper-iron transformer described above or they use a compact copper-iron transformer and step the AC voltage up or down. When using a transformer, the frequency is set higher than that of the commercial-use current, allowing for more compact transformers.

A variety of methods is known for electronic transformers and they can be divided into the internally-excited type of electronic transformers, like the Hartley oscillators, blocking oscillators or similar internally-excited oscillators and the externally-excited electronic transformers.

FIGS. 15(*a*) & 15(*b*) show a schematic example of internally-excited and externally-excited electronic transformer configurations, respectively.

As in the figures, commercial AC voltage with a frequency of 50/60 Hz and a voltage of 100 V is converted into DC voltage by a rectifying circuit 111 and then smoothed in a smoothing circuit 112, which has a capacitor CC, before being applied to an internally-excited oscillation circuit 113.

The internally-excited oscillation circuit 113 of FIG. 15(*a*) is made up of tertiary windings (feedback windings), a transformer Tr1, which has the tertiary windings LL3, a switching element Q1, a resistor R1 and a diode D1.

Voltage is applied to the primary windings LL1 of the transformer Tr1 by switching the switching element Q1 and, along with the generation of voltage in the secondary windings LL2 of the transformer Tr1, voltage is also generated in the tertiary windings LL3. The voltage that is generated in the tertiary windings LL3 returns to the switching element Q1 as positive feedback. This makes the circuit composed of the switching circuit Q1 and the transformer Tr1 to perform the internally-excited oscillation operation, which causes the switching operation of the switching element Q1 to repeat. What this does is to generate an AC voltage of 12 V with a frequency of 20 kHz to 100 kHz in the secondary windings LL2 of the transformer Tr1.

FIG. 15(*b*) is a sample schematic configuration of an externally-excited electronic transformer. As shown in that figure, the rectification circuit 111 converts the commercial voltage of 100 V and a frequency of 50/60 Hz to a DC voltage, which is smoothed in the smoothing circuit 112, which has the capacitor CC, before being applied to the externally-excited oscillation circuit 114.

The externally-excited oscillation circuit 114 is made up of the transformer Tr2, the switching element Q2 and an IC or other generator circuit OSC. The switching element Q2 is driven by the oscillation circuit OSC and the frequency of said oscillation circuit repeats the switching operation. What is does is to generate 12 V of AC voltage with a frequency of 20 kHz to 100 kHz at the secondary windings LL2 of the transformer Tr2.

However, the illumination equipment for a conventional retail store uses halogen lamps or a similar type of lamp. When using halogen lamps that are powered using 12 V AC for illumination, power supply devices containing the electronic transformers described above might be installed up behind the ceiling with power supplied to the lamps from a socket mounted in the surface of the ceiling.

In recent years, there has been increasing demand for LED lamps as substitutes for the halogen lamps described above because they use less power and it is desired that it be made possible to use the halogen lamp power supply equipment without any modification to power LED lamps instead of halogen lamps.

When lighting a lamp using voltage that is lower than commercial AC voltage, a transformer is used on the power supply circuit to step the voltage and because of miniaturization in recent years, it has become common to use electronic transformers.

Electronic transformers include internally-excited and externally-excited types, but when using the internally-excited type of electronic transformers as a power supply for LED lamps, there has been a problem of the LED failing to light up or for lighting to be discontinuous.

This is due to the fact that, if a load current that is greater than a certain degree does not flow, the internally-excited transformer cannot generate stable oscillations and it is thought that in the LED, no current can flow in the low voltage range where the DC-DC converter of the drive circuit operates.

FIG. 16 shows the voltage-current characteristics of an LED and a halogen lamp. As shown in that diagram, a current runs through the halogen lamp that corresponds to the voltage being applied, but no current flows at the LED's low voltage range, and no current will flow until a voltage that is above a certain point is applied.

For this reason, when using an internally-excited electronic transformer as the power supply for an LED lamp, the load current that flows is insufficient, so that the oscillations are not stable.

Because the above problem does not occur unless one uses an internally-excited electronic transformer in the power supply circuit, an externally-excited electronic transformer or similar solution may be used when installing a new power supply circuit to light the LED lamp, which makes it possible to use a power supply circuit that can light the LED lamp in a stable manner. However, it is also possible that LED lamps might be installed instead of halogen lamps in existing illumination equipment that lights halogen lamps, in which case the LED lamp would not be lit stably if an internally-excited electronic transformer were used.

The user does not always know what type of circuit is being used in the power supply circuit of the illumination equipment so that it is possible that an LED lamp could be installed, for example, where the existing equipment is for halogen lamps in which an internally-excited electronic transformer is being used, and in this case, the LED lamp would not go on normally and could give the mistaken impression that the LED lamp was broken.

SUMMARY OF THE INVENTION

This invention was developed with the above circumstances in mind and the purpose of this invention is to provide an LED lamp-lighting circuit that can light an LED lamp stably, an LED lamp and a conversion socket for lighting LED lamps irrespective of the circuit configuration of the power supply circuit.

When running LED drive devices using electronic transformers that employ internally-excited oscillation like Hartley or blocking oscillation, even when the current to the LED is in such a low range that it barely flows, it is necessary that a degree of load current flow into the electronic transformer and if no load current flows into the electronic transformer, the electronic transformer will stop operating and stable oscillation will not be possible.

In order to solve the above problems with this invention, a start-assist circuit was installed into which current flows temporarily when the power supply is turned on and a fixed current load circuit that allows a fixed load current to flow in to the LED lamp-lighting circuit that serves as the load for the electronic transformer. What this does is to cause a load current to flow across the entire principal output voltage of the internally-excited electronic transformer so that the operation of the electronic transformer will not stop.

Additionally, a current-stopping circuit was installed that stops the current from flowing into the fixed current load circuit when the LED driver is operating, which reduces the current on the above fixed current load circuit. This makes it possible to improve the power supply efficiency.

In other words, the above problems are solved in the following ways with this invention.

(1) There is an LED lamp-lighting circuit that is connected between the LED driver that powers the LED and the AC power supply, a rectification circuit that rectifies the AC power supply described above and supplies DC voltage to the above LED driver, a start-assist circuit that contains at least a capacitor, into which excess current flows for a specific period of time after the power supply is turned on, a fixed current load circuit that is connected in parallel to the start-assist circuit described above and into which fixed current flows and there is a current-stopping circuit that stops the current from flowing into the fixed current load circuit described above when the current flows into said LED driver.

(2) In (1) above, a stop operation circuit is installed that stops the operation of the fixed current load circuit described above when no LED is connected.

(3) The LED lamp-lighting circuit above is configured as described in (1) above, in an LED lamp configured using an LED lamp-lighting circuit that is connected to an AC power supply, an LED driver that is connected to the output side of said lamp-lighting circuit and an LED that is driven by said LED driver.

(4) An LED lamp-lighting circuit that is configured as in (1) above, is built into a conversion socket for lighting LED lamps that is connected between the AC power supply and a lamp unit made up of an LED and an LED driver for running said LED.

Effect Of The Invention

With this invention, the following effects can be achieved.

(1) The LED lamp-lighting circuit is equipped with a fixed current load circuit into which a fixed load current can flow as well as a start-assist circuit into which current flows temporarily when the power supply is turned on so that even if an internally-excited electronic transformer is used for the power supply circuit of the LED lamp, the LED will remain on steadily without any flickering.

(2) There is a current-stopping circuit that stops the current from flowing into the fixed load current circuit described above when current flows into the LED driver so that current will not always be flowing into the fixed load current circuit and power consumption efficiency will not be reduced.

BRIEF DESCRIPTION OF THE DRAWINGS

FIG. 2 is a block diagram showing the basic configuration of an LED module made up of an LED and an LED driver.

FIG. 3 is a diagram showing the lamp-lighting circuit configuration of the first embodiment of this invention.

FIGS. 10(*a*) and (*b*) are schematic views showing sample configurations of halogen-type LED lamps incorporating the lamp-lighting circuit of this invention.

FIGS. 11(*a*) and (*b*) are schematic views showing sample configurations of bulb-type LED lamps incorporating the lamp-lighting circuit of this invention.

FIGS. 12(*a*) and (*b*) are schematic views showing sample configurations of conversion sockets incorporating the lamp-lighting circuit of this invention.

FIGS. 15(*a*) and (*b*) are diagrams showing a sample configuration of conventional internally-excited and externally-excited electronic transformers.

DETAILED DESCRIPTION OF THE INVENTION

Figure 1:
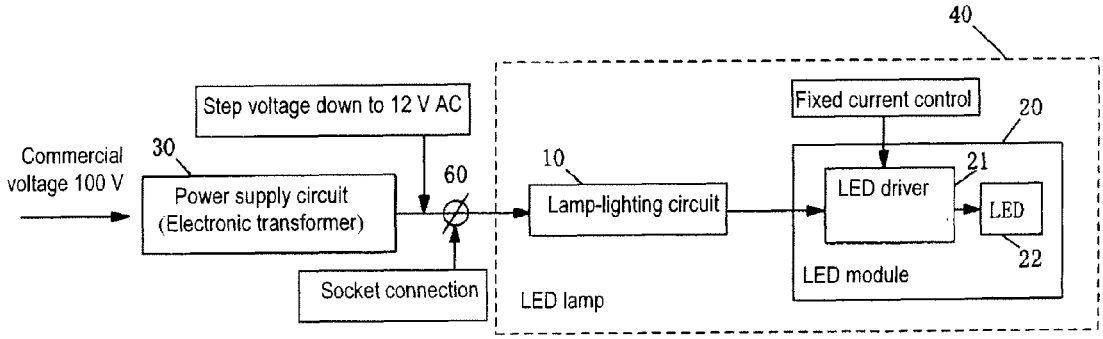
FIGS. 1(*a*) & 1(*b*) are diagrams showing the overall configuration of the LED lamp-lighting device containing a power supply circuit and the lamp-lighting circuit of this invention.
Figure 1:
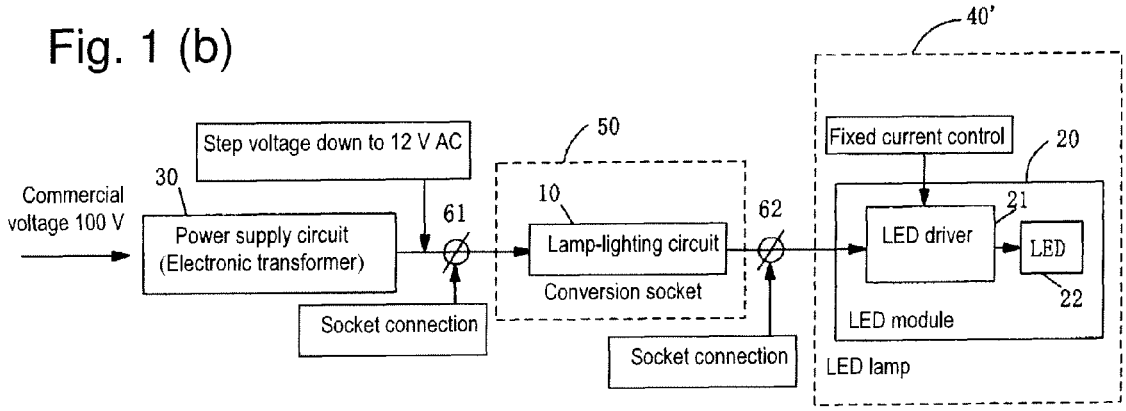

FIG. 1(*a*) is a diagram showing a configuration in which a lamp-lighting circuit has been built into the LED lamp. As that figure shows, when a 100 V AC commercial power supply is supplied to the power supply circuit 30, which is made up of an electronic transformer or similar device, it is dropped to, for example, 12 V AC. This AC voltage is supplied to the LED lamp 40, which contains the lamp-lighting circuit 10 of this invention shown in FIG. 2 and an LED module 20, which is made up of an LED driver 21 and an LED 22.

The power supply circuit 30 described above could be installed behind the ceiling or somewhere similar and the LED lamp 40 that contains the lamp-lighting circuit described above could be installed in the surface of the ceiling and connected using a screw-type or a pin-type connecting power supply module 60.

The lamp-lighting circuit 10 is equipped with the following: A current rectifying circuit 11 that supplies DC voltage to the LED driver 21 after rectifying the AC voltage output by the power supply circuit 30 described above as shown in FIG. 2, a start-assist circuit 12 into which excess current flows for a specific period of time after the power supply is turned on, a fixed current load circuit 13, which is connected in parallel to the start-assist circuit 12 and into which fixed current flows, a current-stopping circuit 14 that stops the current from flowing into the fixed current load circuit 13 described above when the current is flowing into the LED driver 21, and an operation-stopping circuit 15 that stops the operation of the fixed current load circuit 13 described above when the LED 22 is not connected.

In FIG. 2, the current rectifying circuit 11 performs full-wave rectification on the AC voltage that is output by the power supply circuit 30.

When the power supply is turned on, the current I1 flows into the start-assist circuit 12 for a specific amount of time and the current I1 flows by means of the start-assist circuit 12 until the operation of the fixed current load circuit 13 begins. Subsequently, when the fixed current load circuit 13 begins operation, a current I2 will flow from the power supply circuit 30 side into the fixed current load circuit 13 until current flows into the LED driver 21. Furthermore, when the current I3 flows into the LED driver 21, it will be detected by the current-stopping circuit 15 and the operation of the fixed current load circuit 13 will be stopped.

When the LED 22 is not connected, it will be detected that the LED driver 21 output voltage is higher than the forward voltage Vf of the LED 22 and the operation-stopping circuit 15 will stop the operation of the fixed current load circuit 13.

When the LED 22 is connected, current will flow into the lamp-lighting circuit 10 across the entire output voltage of the power supply circuit 30 so that even if the power supply circuit 30 is configured using an internally-excited electronic transformer, such problems as the operation stopping, the operation becoming unstable or the LED lamp flickering will be avoided.

FIG. 1(*b*) is a figure showing the entire configuration of the LED lamp-lighting device when the configuration is such that the lamp-lighting circuit is not installed inside the LED lamp but in the LED lamp-lighting conversion socket and can be separated from the LED lamp.

In this figure, the lamp-lighting circuit described above is installed in the LED lamp-lighting conversion socket 50 and the LED lamp, which is configured using the LED module 20 that contains the LED 22, is connected to the power supply circuit 30 via the lamp-lighting conversion socket 50 described above.

In this way, the lamp-lighting circuit 10 described above is installed inside the LED lamp-lighting conversion socket 50 and, depending on the type of lamp and the power supply circuit configuration, it will be possible to make selective use of the lamp-lighting circuit 10 described above.

Next, some specific examples of the lamp-lighting circuit configurations of this invention will be discussed.

FIG. 3 is a diagram showing the configuration of the lamp-lighting circuit of the first embodiment of this invention. It shows the LED module that is made up of the LED, LED driver and the lamp-lighting circuit pertaining to this invention. In the example transistors are used as the switching elements Q1 through Q3.

In FIG. 3, the rectifying diodes D1, D2, D3 and D4 that make up the full wave rectification circuit, are placed in the current rectifying circuit 11 and the AC voltage that is supplied from the power supply module 60 undergoes full wave rectification, becoming DC voltage.

The start-assist circuit 12 is equipped with a capacitor C1 and resistor R1 that are connected in series and in parallel to the output side of the current rectifying circuit 11. AC voltage is supplied to the power supply module 60 and, when DC voltage is applied to the start-assist circuit 12, the capacitor C1 is charged up via the resistor R1. Current flows from the power supply module 60 into the start-assist circuit 12 via the current rectifying circuit 11 until the capacitor C1 stops charging.

The fixed current load circuit 13 is connected in parallel to the start-assist circuit 12 described above and is made up of the series circuit comprised of Zener diode ZD1, resistor R2 and switching element Q1, the emitter and collector of which are connected in series to the resistors R3, R4, and the base of which is connected to the connection point of the resistor R2 and the Zener diode ZD1.

The collectors of the switching elements Q2, Q3 of the current-stopping circuit 14 and the operation-stopping circuit 15 are connected at the connecting point of the Zener diode ZD1 and the resistor R2 described above and, when the switching elements Q2, Q3 are off, the switching element Q1 will be on and when the switching elements Q2, Q3 are on, the switching element Q1 will be off.

When the switching elements Q2, Q3 are off, the base potential of the switching element Q1 is kept at a fixed potential by the Zener diode ZD1 and the resistor R2 and the potential of the emitter is kept at a level that is nearly equivalent to the base potential. For this reason, a fixed current that corresponds to the base potential flows into the resistor R4. If we call the Zener diode voltage Vz and the voltage between the base and the emitter of the switching element Vbe, then the current I1 that flows into the switching element Q1 can be expressed as: I1=(Vz−Vbe)/R4.

In other words, when the switching elements Q2, Q3 are off, the fixed current described above flows into the switching element Q1 and the circuit that is configured using the switching element Q1 functions as the fixed current load circuit.

As above, the lamp-lighting circuit of this embodiment is equipped with the start-assist circuit 12 into which excess current flows for a specific period of time after the power supply is turned on (from the time that voltage is applied to the power supply module 60) and the fixed current load circuit 13, which is connected in parallel to this start-assist circuit 12 and into which a fixed current flows.

When voltage is applied to the power supply module 60, the output voltage from the current rectifying circuit 11 will exceed the operating voltage of the switching element Q1 and current will flow into the start-assist circuit 12 until the current starts to flow into the fixed current load circuit, and once the fixed current load circuit 13 begins operating, a fixed current will flow into the fixed current load circuit.

When the fixed current load circuit 13 is operating as described above, the current flows into the fixed current load circuit 13 from the power supply module 60, but when the current flows into the fixed current circuit 13 while the current is flowing into the LED 22 when the LED driver 21 goes into operation, there will be needless power consumption.

For this reason, the current-stopping circuit 14 is used to stop the current from flowing into the fixed current load circuit 13 described above when the current is flowing into the LED driver 21.

The current-stopping circuit 14 is made up of the resistors R7, R8 and the switching element Q3 and, when the current flows into the LED driver 21 and voltage is generated in both ends of the resistor R8, which is connected to the LED driver in a linear fashion, the switching element Q3 turns on. This makes the base of the switching element Q1 of the fixed current load circuit 13 take on the potential of the ground, turning off the switching element Q1 and stopping the influx of fixed current.

The current Istop that stops the fixed current load circuit 13 when the switching element Q3 base/emitter voltage is Vbe can be expressed as Istop=Vbe/R8. When the current flowing through the LED driver 21 exceeds the Istop, the fixed current load circuit 13 stops operating.

The operation-stopping circuit 15 is made up of the LED driver 21, the Zener diode ZD2, one terminal of which is connected to the connection point on the positive side of the LED 22, the resistor R6 that is connected between the other terminal of the Zener diode ZD2 and ground, the switching element Q2, and the resistor R5, which is connected between the connection point of the resistor R6 and the Zener diode ZD2 and base of the switching element Q2.

As described above, when the LED 22 is not connected to the LED driver 21, the LED driver 21 output voltage will rise due to the forward voltage of LED 22.

The Zener voltage of the Zener diode ZD2 described above is selected as the voltage where the switching element Q2 turns on when the output voltage of the LED driver 21 rises above the forward voltage of the LED 22.

For this reason, if the LED 22 is not connected to the LED driver 21, the switching element Q2 of the operation-stopping circuit 15 will turn on, the base of the switching element Q1 of the fixed current load circuit 13 will equal the ground potential, turning off the switching element Q1 and stopping the influx of fixed current. In other words, when the LED 22 is connected to the LED driver 21, the operation-stopping circuit 15 will stop the operation of the fixed current load circuit 13 and prevent the wasteful consumption of power.

If we call the Zener voltage of the Zener diode ZD2 Vz and the emitter voltage of the switching element Q2 base/emitter Vbe, then we can express the operation-stopping following Vstop of the operation-stopping circuit 15 as Vstop=Vz+Vbe and when the output voltage of the LED driver 21 is higher than Vstop, the operation of the fixed current load circuit will stop and current will stop flowing into the lamp-lighting circuit.

As above, with the lamp-lighting circuit of this embodiment, excess current will flow into the start-assist circuit 12 for a specific period of time after the power supply is turned on and then, after the operation of the fixed current load circuit 13 has started, a fixed current will flow into the fixed current load circuit 13 and when the current flows into the LED driver 21, the current flowing into the fixed current load circuit 13 will stop.

In other words, when the LED driver 21 and the LED 22 are connected to the lamp-lighting circuit of this embodiment, current will flow into the lamp-lighting circuit from the power supply circuit 30 over the entire operating voltage. For this reason, even if an internally-excited electronic transformer is installed in the power supply circuit, the internally-excited electronic transformer will not stop operating and the LED will not flicker. Also, when current flows into the LED driver 21, the current-stopping circuit 14 will stop the current from flowing into the fixed current load circuit 13 so that there will not be any wasteful power consumption.

Moreover, if, for some reason, the LED 22 is not connected to the LED driver 21, the current flowing into the fixed current load circuit 13 will be stopped by the operation-stopping circuit 15 so that there will be no problem of current flow even when LED 22 is not connected.

Figure 4:
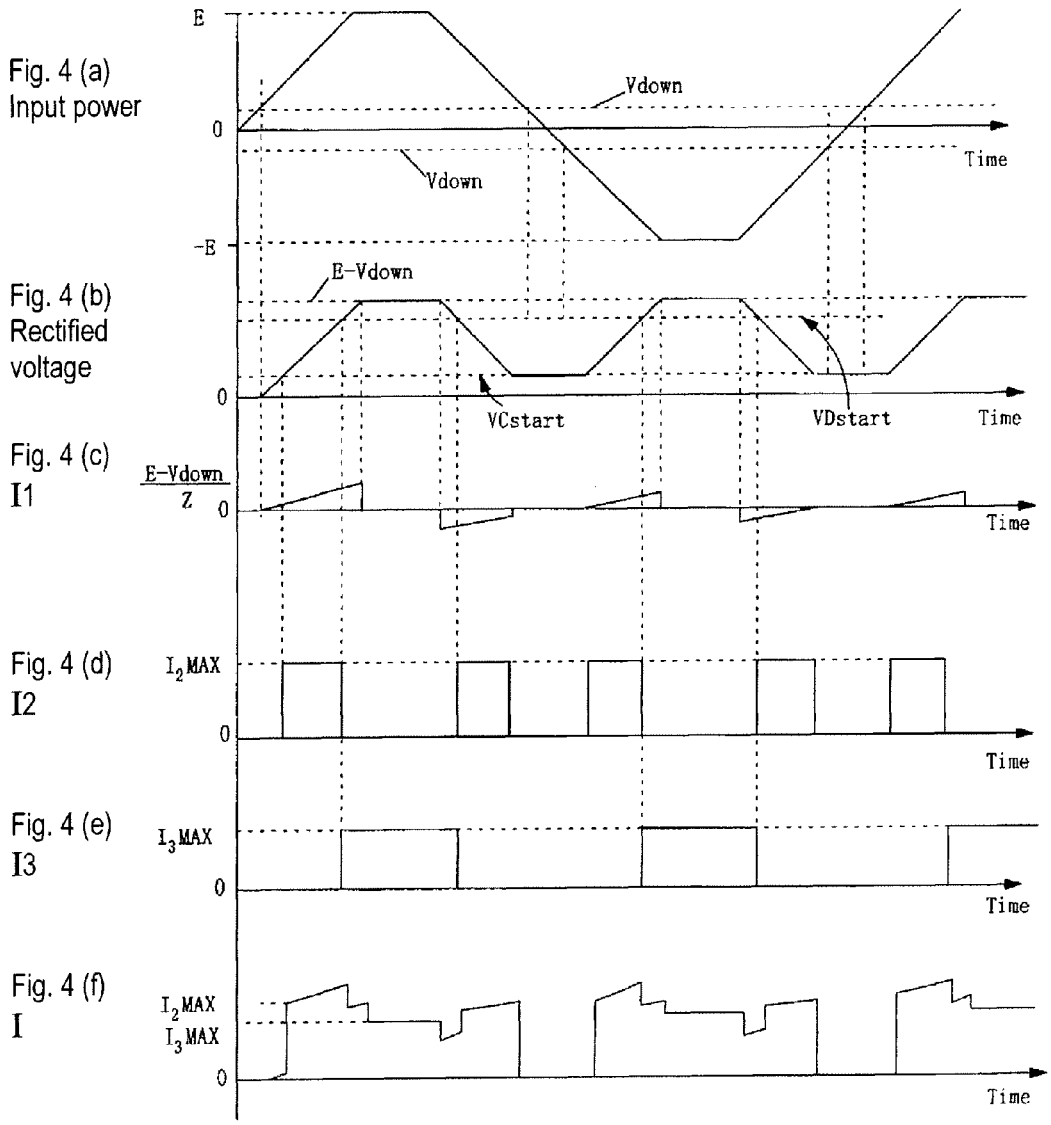
FIGS. 4(*a*)-4(*f*) are time charts showing the voltage of each part of the lamp-lighting circuit of this invention during operation and the main parts of the current waveform.

FIGS. 4(*a*)-(*f*) are time charts showing a summary of the voltages and current waveforms for each part during the operation of the lamp-lighting circuit of this invention, where the horizontal axis represents time.

FIG. 4(*a*) shows that the input voltage waveform that is input into the lamp-lighting circuit of this embodiment from the power supply circuit 30 equipped with an electronic transformer has a peak voltage which is "E." Note also that Vdown is the drop voltage at the current rectifying circuit 11.

FIG. 4(*b*) indicates the voltage waveform after rectification by the current rectifying circuit 11 and, because the voltage drops at the current-rectifying circuit 11, the peak value will be E−Vdown. Also VCstart in the diagram represents the voltage at which operation of the fixed current load circuit 13 begins and VCstart is the voltage at which the operation of the LED driver 21 begins.

In the figure, the current I1, I2, and I3 of (c), (d) and (e) are the current values at the places indicated in FIG. 2 above and they represent the current that flows into the start-assist circuit 12, the fixed current load circuit 13 and the LED driver 21, respectively, while the current I at (f) represents the total of the current values I1, I2 and I3.

If we call Z the impedance of the start-assist circuit 12, then, when the voltage is leading/trailing, the current I1 will flow into the start-assist circuit 12 with a peak value of just about (E−V down)/Z as shown in 4(*c*).

Also, once the size of the input voltage exceeds VCstart, the fixed current load circuit 13 will begin to operate and, as shown in 4(*d*), the current I2 will flow into the fixed current load circuit 13.

Furthermore, when the size of the input voltage exceeds VDstart, the LED driver 21 will begin to operate and, as shown in 4(*e*), the current I3 will flow into the LED driver 21.

Therefore, the current I that flows into the lamp-lighting circuit will be the sum of the current values I1, I1, and I3, named above, resembling what is shown by 4(*f*). In other words, if the input voltage is at least as high as the voltage value, current will always flow into the lamp-lighting circuit and even if an internally-excited electronic transformer is used in the power supply circuit 30, the operation will not stop and it will not become unstable.

Figure 5:
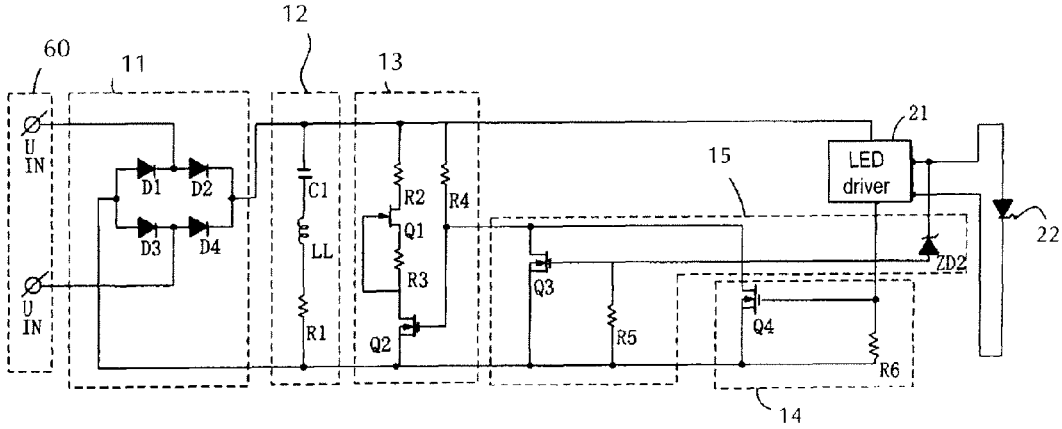
FIG. 5 is a diagram showing the lamp-lighting circuit configuration of the second embodiment of this invention.

FIG. 5 is a diagram showing the second embodiment of this invention, showing an example that uses FETs for the switching elements Q1 through Q3. The operation is basically the same as that shown in FIG. 4 above.

In FIG. 5, the current rectifying circuit 11 has current rectifying diodes D1, D2, D3 and D4, which make up the full wave current rectifying circuit and the full wave of the AC voltage supplied from the power supply module 60 will be rectified, becoming DC voltage.

In addition to the capacitor C1 and the resistor R1 that are connected in series, the inductor LL has been added to the start-assist circuit 12. As described above, when a DC voltage is applied to the start-assist circuit 12, the capacitor C1 charges up via the resistor R1 and the inductor LL and current will flow into the start-assist circuit until the capacitor C1 finishes charging.

In the example in FIG. 5, since the inductor LL is used in the start-assist circuit 12, it is possible to reduce losses further than the unit shown in FIG. 4 above.

The fixed current load circuit 13 is made up of the switching elements Q1, Q2, and the resistors R2 through R4 and it is connected in parallel to the start-assist circuit 12 described above. The switching elements Q3, Q4 of the current-stopping circuit 14 and the operation-stopping circuit 15 are connected to the connection point between the switching element Q2 and the resistor R4 named above and the when the switching elements Q3, Q4 are off, a uniform current will flow into the fixed current load circuit 13.

The current-stopping circuit 14 is made up of the resistor R6 and the switching element Q4 and current flows into the LED driver 21. When voltage is produced at both ends of the resistor R6, which is connected in a linear fashion to the LED driver 21, the switching element Q4 will turn on, stopping the operation of the fixed current load circuit 13.

Also, the operation-stopping circuit 15 is made up of the switching element Q3, the Zener diode ZD2, one terminal of which is connected to the plus-side connecting point of the LED 22 and the LED driver 21 and the resistor R5, which is connected between the other terminal of the Zener diode ZD2 and ground.

When the LED 22 is not connected to the LED driver 21, the output voltage of the LED driver 21 will rise, as described above, turning on the switching element Q3 and stopping the operation of the fixed current load circuit 13.

As described above and like the first embodiment, the lamp-lighting circuit of this embodiment is equipped with the start-assist circuit 12, into which excess current flows for a specific period of time after the power supply is turned on, and the fixed current load circuit 13, which is connected in parallel to this start-assist circuit 12 and into which a fixed current flows.

When voltage is applied to the power supply module 60, the output voltage of the current rectifying circuit 11 will exceed the operating voltage of the switching element Q1 and current will flow into the start-assist circuit 12 until current begins to flow into the fixed current load circuit and when the fixed current load circuit 13 begins operation, uniform current will flow into the fixed current load circuit. Furthermore, when the LED driver 21 begins operation, the current-stopping circuit 14 will cause the current in the fixed current load circuit 13 to stop flowing.

Also, if the LED 22 is not connected to the LED driver 21, the operation-stopping circuit 15 will cause the operation of the fixed current load circuit 13 to stop.

Figure 6:
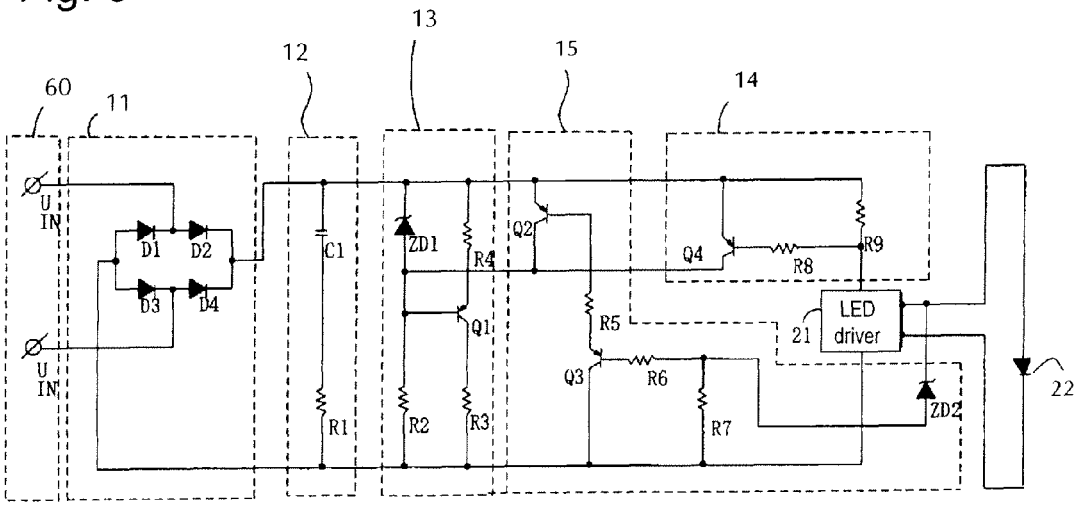
FIG. 6 is a diagram showing the lamp-lighting circuit configuration of the third embodiment of this invention.

FIG. 6 is a diagram showing the third embodiment of this invention. It shows an example in which PNP transistors have been used for the switching elements Q1 through Q4 and their operation is basically the same as that shown in FIG. 4 above.

In FIG. 6, the current rectifying circuit 11 rectifies the full wave of the AC voltage supplied from the power supply module 60, turning it into DC voltage. The start-assist circuit 12 is equipped with the capacitor C1 and the resistor R1, which are connected in a linear fashion and, as described above, when a DC voltage is applied to the start-assist circuit 12, current will flow into the start-assist circuit until the capacitor C1 finishes charging.

The fixed current load circuit 13 is made up of the resistors R2 through R4, the Zener diode ZD1, and the switching element Q1, which consists of a PNP transistor and, as described above, when the switching elements Q2, Q3 of the current-stopping circuit 14 and the operation-stopping circuit 15 are off, a uniform current flows into the fixed current load circuit 13.

The current-stopping circuit 14 is made up of the resistors R8, R9 and the switching element Q4 and, because current flows to the LED driver 21 and voltage is generated on both ends of the resistors R9, which is connected in a linear fashion to the LED driver 21, the switching element Q4 turns on, causing the operation of the fixed current load circuit 13 to stop.

Also, the operation-stopping circuit 15 is made up of the LED driver 21, the Zener diode ZD2, one terminal of which is connected to the connection point on the positive side of the LED 22, the resistor R7, which is connected between ground and the other terminal of the Zener diode ZD2, the switching elements Q2, Q3 and the resistor R6.

When the LED 22 is not connected to the LED driver 21, the output voltage of the LED driver 21 rises, as described above, turning the switching element Q3 on and causing the operation of the fixed current load circuit 13 to stop.

Figure 7:
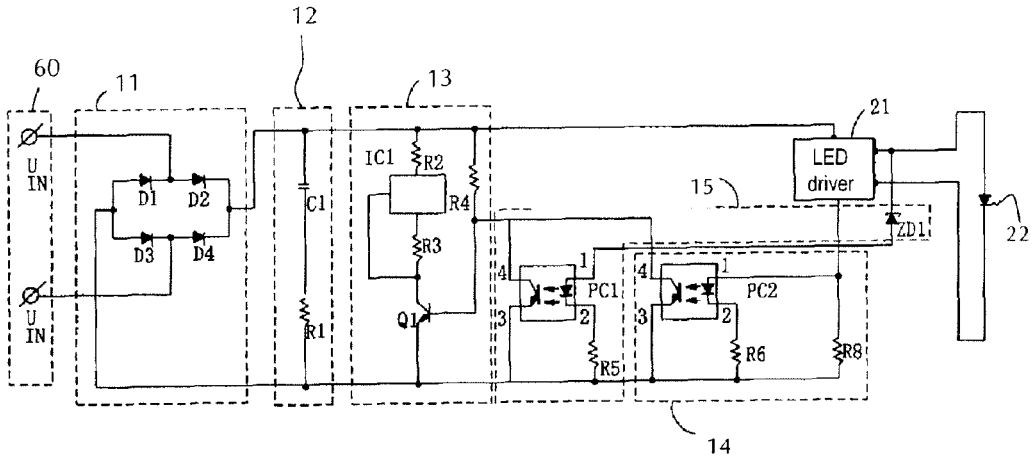
FIG. 7 is a diagram showing the lamp-lighting circuit configuration of the fourth embodiment of this invention.

FIG. 7 is a diagram showing the fourth embodiment of this invention and, along with using the integrated circuit IC1, which has a current fixing function, in the fixed current load circuit, the example shown using the current-stopping circuit 14, the operation-stopping circuit 15 and the photocouplers PC1 and PC2. Its operation is basically the same as the unit shown in FIG. 4 above.

In FIG. 7, the current-rectifying circuit 11 rectifies the AC voltage supplied by the power supply module 60, forming DC voltage and, when DC voltage is applied to the start-assist circuit 12, current will flow into the start-assist circuit 12 until the capacitor C1 charges up completely.

The fixed current load circuit 13 is made up of the integrated circuit IC1, the resistors R2 through R4 and the switching element Q1 and, when the photocouplers PC1 and PC2 of the current-stopping circuit 14 and the operation-stopping circuit 15 are off, uniform current will flow into the fixed current load circuit 13.

The current-stopping circuit 14 is made up of the resistors R6, R8 and the photocoupler PC2, and when the current flows into the LED driver 21, voltage is generated on both ends of the resistor R8, which is connected in a linear fashion to the LED driver 21, turning the photocoupler PC2 on and causing the operation of the fixed current load circuit 13 to stop.

Additionally, the operation-stopping circuit 15 comprises the LED driver 21 and Zener diode ZD2, one terminal of which is connected to the connection point on the positive side of the LED 22, the resistor R5 and the photocoupler PC1 and when the LED 22 is not connected to the LED driver 21, the photocoupler PC1 turns on, causing the operation of the fixed current load circuit 13 to stop.

Figure 8:
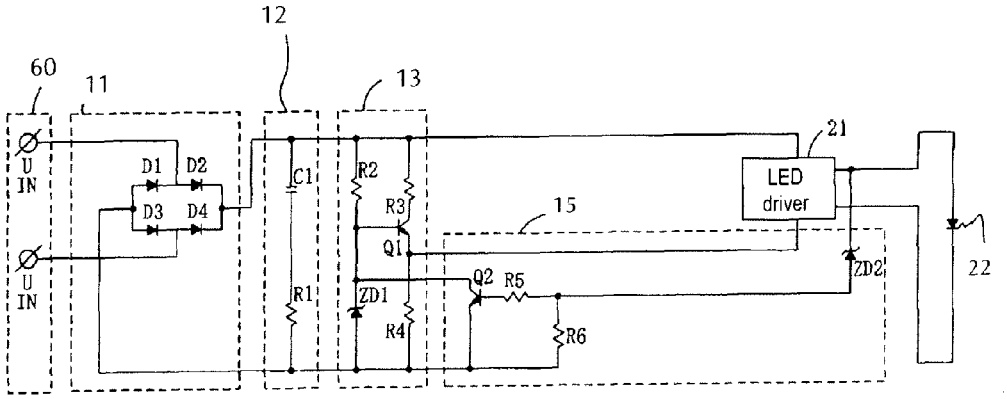
FIG. 8 is a diagram showing the lamp-lighting circuit configuration of the fifth embodiment of this invention.

FIG. 8 is a diagram showing the fifth embodiment of this invention. In FIG. 4, the current flowing into the LED driver 21 and the LED would return to the resistor R4, which was connected to the emitter side of the switching element Q1 of the fixed current load circuit 13, which caused the LED driver 21 to operate, lowering the current flowing into the fixed current circuit 13. The current-stopping circuit 14 shown in FIG. 4 above has been omitted and its operation is basically the same as was shown in FIG. 4 above.

In FIG. 8, the current rectifying circuit 11 rectifies the full wave of the AC voltage supplied by the power supply module 60, producing DC voltage and, when DC voltage is applied to the start-assist circuit 12, current will flow into the start-assist circuit 12 until the capacitor C1 finishes charging.

The fixed current load circuit 13 is made up of the resistor R2, the linear circuit of the Zener diode ZD1, the resistor R2, and the switching element Q1, the base of which is connected to the connection point of the Zener diode ZD1 and the emitter and collector of which are connected in a linear fashion to the resistors R3, R4.

The switching element Q2 of the operation-stopping circuit 15 is connected to the connection point of the Zener diode ZD1 and the resistor R2 described above. For this reason, when the switching element Q2 of the operation-stopping circuit 15 is off, the switching element Q1 will be on, but if the switching element Q2 turns on when the LED 22 is not connected, the switching element Q1 will turn off and the operation of the fixed current load circuit 13 will stop.

If we call the Zener voltage of the Zener diode ZD2 Vz and the base/emitter voltage of the switching element Q2 Vbe, then the operation-stopping voltage Vstop from the operation-stopping circuit 15 can be expressed as Vstop=Vz+Vbe and, when the output voltage of the LED driver 21 is higher than Vstop, the operation of the fixed current load circuit 13 will stop. Because no current flows into the lamp-lighting circuit, the operation will stop if an internally-excited electronic transformer is used in the power supply circuit.

Additionally, the ground side of the LED driver 21 is connected to the connection point of the resistor 4 and the switching element Q1. For this reason, when the LED driver 21 operates and current flows through the resistor R4, the emitter potential of the switching element Q1 increases, lowering the current flowing to the switching element Q1.

If we call the current that flows into the resistor R3 and the switching element Q1 I1, the current that flows into the LED driver 21 and the LED 22 I2, and the Zener voltage of the Zener diode ZD2 Vz, then I1+I2=(Vz−Vbe)/R4 and the current that flows into the resistor R3 and the switching element Q1 will be reduced by the amount that is flowing into the LED driver 21.

In other words, this circuit functions in the same manner as the current-stopping circuit 14 and when the LED driver 21 operates, the current flowing into the fixed current load circuit 13 will be reduced.

As above, with this embodiment, the ground side of the LED driver 21 has been connected to the connected point of the resistor R4 and the emitter of the switching element Q1 so that in the same way as the current-stopping circuit 14, when current flows into the LED driver 21, the current flowing into the fixed current load circuit 13 will be reduced and the power consumption can be reduced.

Figure 9:
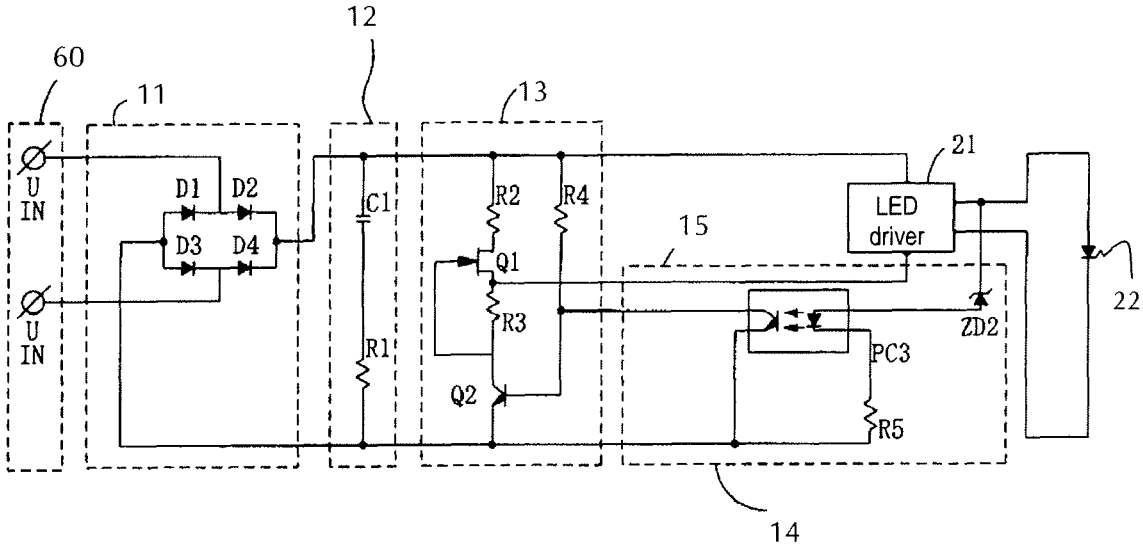
FIG. 9 is a diagram showing the lamp-lighting circuit configuration of the sixth embodiment of this invention.
Figure 13:
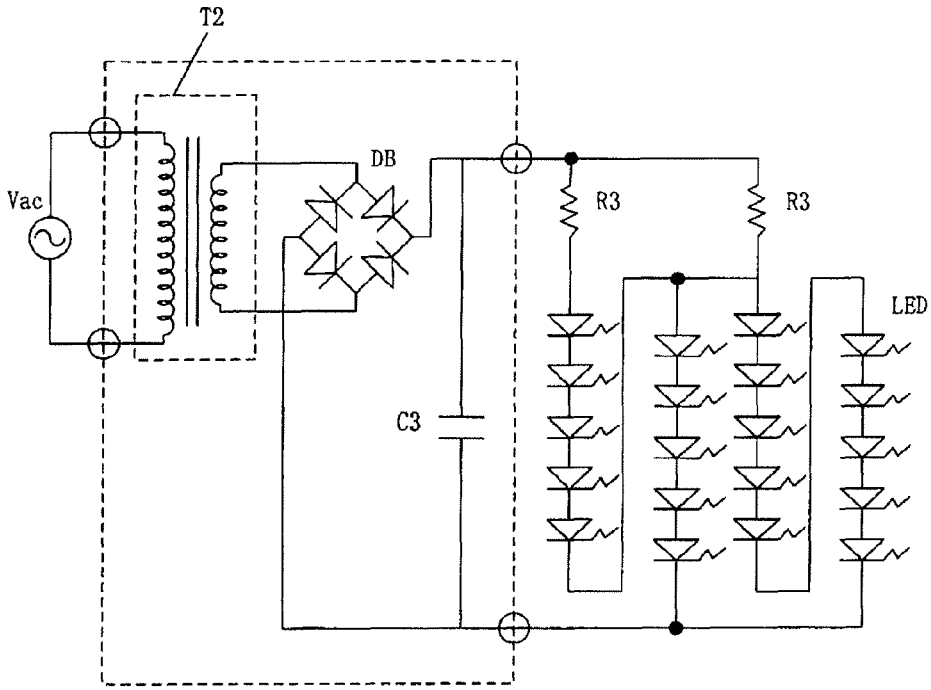
Fig. 13 (Prior Art)
FIG. 13 is a diagram showing a typical, conventional lamp-lighting circuit shown in FIG. 5 of Japanese Unexamined Patent Application Publication 2006-34491.
Figure 14:
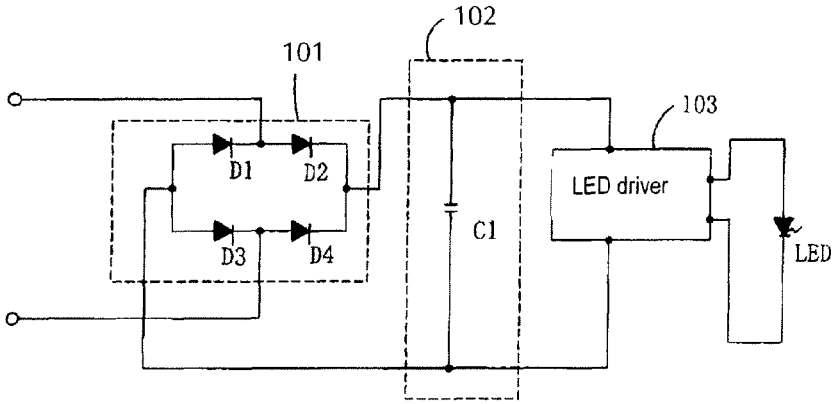
Fig. 14 (Prior Art)
FIG. 14 is a diagram showing an example of a conventional lamp-lighting circuit using an LED driver.
Figure 16:
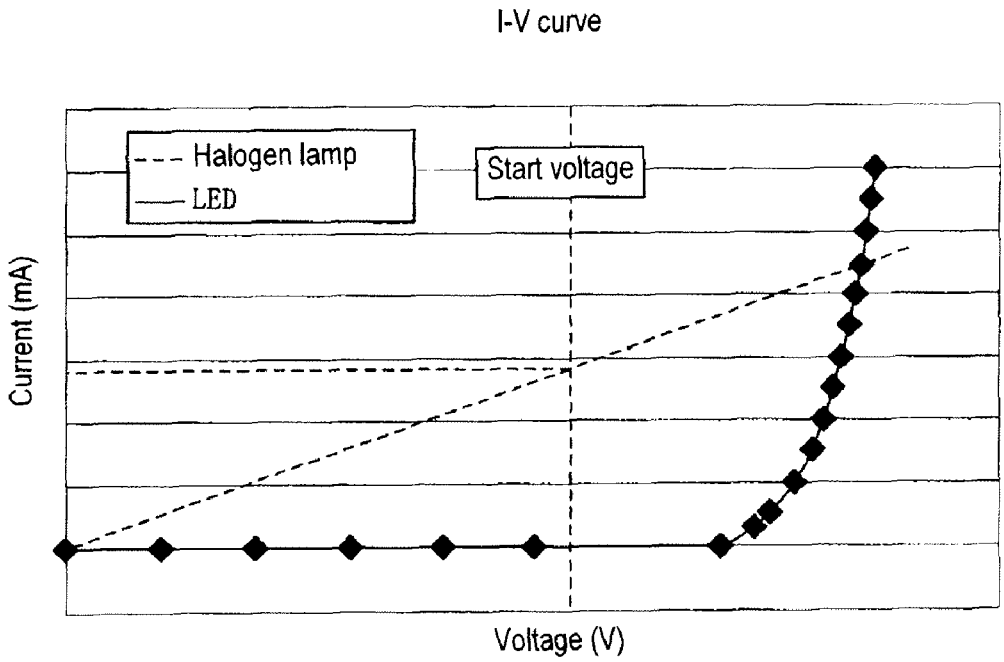
Fig. 16 (Prior Art)
FIG. 16 is a diagram showing the voltage-current characteristics of LED and halogen lamps.

FIG. 9 is a diagram showing the sixth embodiment of this invention. Here, an FET has been used as the switching element of the fixed current load circuit and, by returning the current that flows into the LED and the LED driver 21 to the resistor R3 of the fixed current load circuit 13 as shown in FIG. 8, when the LED driver 21 is operating, the current flowing into the fixed current circuit 13 is reduced and the current-stopping circuit 14 shown in FIG. 4 has been simplified, but the operation is basically the same as the unit shown in FIG. 4 above.

In FIG. 9, the rectifying circuit 11 rectifies the full wave of the AC voltage supplied from the power supply module 60, producing DC voltage and, when DC voltage is applied to the start-assist circuit 12, current will flow into the start-assist circuit 12 until the capacitor C1 has finished charging.

The fixed current load circuit 13 is made up of the switching element Q1, which is composed of the resistors R2 through R4 and the FET, and the switching element Q2, which is formed of a transistor. The ground side of the LED driver 21 is connected to the connection point of the resistor R3 and the switching element Q2 described above.

For this reason, when the LED driver 21 operates and current flows through the resistor R3, the current flowing into the switching element Q1 is reduced, as stated earlier. In other words, this circuit functions in the same manner as the current-stopping circuit 14 and makes it possible to reduce the amount of power consumed.

The operation-stopping circuit 15 is made up of the LED driver 21, the Zener diode ZD2, one terminal of which is connected to the positive connection point of the LED 22, the resistor R5, which is connected between ground and the other terminal of the Zener diode ZD2 and the photocoupler PC3.

When the LED 22 is not connected to the LED driver 21, the output voltage of the LED driver 21 rises, as stated above, and the photocoupler PC3 turns on, causing the switching element Q2 to turn off and the fixed current load circuit 13 operation to stop.

Next, we will describe a configuration example in which the lamp-lighting circuit of this invention above is incorporated into an LED lamp or incorporated into a conversion socket, as was stated in the explanation of FIGS. 1 (*a*) and (*b*).

FIGS. 10 & 11 are diagrams showing sample configurations of an LED lamp incorporating the lamp-lighting circuit of this invention as described in FIG. 1(*a*) above.

FIGS. 10 (*a*) and (*b*) are schematic views showing sample configurations of halogen lamp types of an LED lamp where the upper lamp (FIG. 10 (*a*)) has a screw socket in the power supply module and the lower lamp (FIG. 10 (*b*)) has a pin socket in the power supply module. Otherwise, the two lamps are the same.

As shown in FIG. 10, the screw socket 9 or two-pin sockets 8 have been attached to the power supply module in the screw base 1 or the two-pin base 6. The AC voltage that is supplied from either the screw socket 9 or the two-pin socket 8 through the lead wire 2*a*, is supplied to the lamp-lighting circuit module 2, which is equipped with the lamp-lighting circuit 10 of this invention. The output of the lamp-lighting circuit 2 is supplied to the LED module 3, which includes the LED 22, via the lead wire 2*b*.

The LED module 3 is attached inside the reflector 4 and the entire front surface of the reflector is covered with the front glass piece 5. When the LED lamp is turned on, the light from the LED is reflected from the reflector 4 and radiated from the front glass piece 5.

FIGS. 11 (*a*) and (*b*) are schematic views showing sample configurations of bulb-type LED lamps, where the upper lamp (FIG. 11 (*a*)) has a screw socket in the power supply module and the lower lamp (FIG. 11 (*b*)) has a pin socket in the power supply module with the two lamps otherwise being the same. As shown in FIG. 11, AC voltage supplied from the screw socket 9 or the two-pin socket 8 passes through the lead wire 2*a* and is supplied to the lamp-lighting circuit module 2, which is equipped with the lamp-lighting circuit 10 of this invention. The output from the lamp-lighting circuit module 2 is supplied to the LED module 3, which contains the LED 22, via the lead line 2*b*.

The LED module 3 is attached inside the bulb glass 7 and when the LED is turned on, the light from the LED is radiated from the bulb glass 7.

FIGS. 12 (*a*) and (*b*) are schematic views showing sample configurations of conversion sockets into which the lamp-lighting circuit of this invention described in FIG. 1(*b*) above, has been incorporated. The upper configuration (FIG. 12 (*a*)) is of a conversion socket equipped with a two-pin socket and a screw socket while the lower configuration (FIG. 12 (*b*)) is of a conversion socket equipped with a screw socket and a screw socket.

As shown in FIG. 12, the screw socket 9 (or two-pin socket 8), which is the power supply module, is attached to the screw base 1. The AC voltage supplied from the screw type base passes through the lead wire and is supplied to the lamp-lighting circuit module 2, which is equipped with the lamp-lighting circuit 10 of this invention. The output from the lamp-lighting circuit module 2 passes through the lead wire 2*b* and is connected to the two-pin socket 8 or the screw socket 9.

By connecting the conversion socket described above to the power supply circuit and connecting the LED lamp that has an LED module in the two-pin socket 8 or in the screw socket 9, to which the output of the lamp-lighting circuit module 2 described above is connected, even if an internally-excited electronic transformer is used for the power supply circuit, the LED lamp will be able to be lit in a stable manner.

What is claimed is:

1. An LED lamp-lighting circuit, comprising:

an alternating current (AC) power supply, an LED driver that drives an LED, an LED lamp-lighting circuit connected between the LED driver and the alternating current (AC) power supply and, a current rectifying circuit that rectifies the AC power supply and supplies DC voltage to said LED driver, a start-assist circuit having at least a capacitor, the start-assist circuit being connected in parallel to an output side of the current rectifying circuit and into which excessive current flows for a specific period of time after the power supply has been turned on, a fixed current load circuit connected in parallel to the start-assist circuit and into which fixed current flows, and a current stopping circuit that stops the current from flowing into said fixed current load circuit when current flows into the LED driver.

2. The LED lamp-lighting circuit described in claim 1, further comprising an operation-stopping circuit that stops operation of the fixed current load circuit when no LED is connected.

3. An LED lamp, comprising:

an LED lamp-lighting circuit connected to an AC power supply and having a current rectifying circuit for rectifying the AC power supply, an LED driver connected to an output side of said lamp-lighting circuit and receiving a DC voltage from the current rectifying circuit, an LED that is driven by said LED driver, a start-assist circuit that is connected in parallel to an output side of the current rectifying circuit, and has at least a capacitor and into which excessive current flows for a specific time after the power supply has been turned on, a fixed current load circuit that is connected in parallel to the LED driver and into which a fixed current flows and a current stopping circuit that stops the current from flowing into the fixed current load circuit when current flows into the LED driver.

4. A conversion socket for connection between an LED lamp unit, having an LED and an LED driver that drives said LED, and an AC power supply for lighting the LED, comprising:

a built-in LED lamp-lighting circuit having a current rectifying circuit that rectifies AC power and supplies DC voltage to the LED driver, a start-assist circuit connected in parallel to an output side of said current rectifying circuit which contains at least a capacitor and into which excess current flows for a specific period of time after the power supply is turned on, a fixed current load circuit connected in parallel to the start-assist circuit and into which a fixed current flows, and a current stopping circuit that stops current from flowing into the fixed current load circuit when current flows into said LED driver.

5. A conversion socket according to claim 4, wherein one of a screw socket and a two-pin socket are connected to an output side of the lamp-lighting circuit and wherein a screw base for connection to the AC power supply is connected to an input side of the lamp-lighting circuit.

* * * * *